US009299469B2

(12) United States Patent
Larson et al.

(10) Patent No.: US 9,299,469 B2
(45) Date of Patent: Mar. 29, 2016

(54) RADIATION WINDOW WITH SUPPORT STRUCTURE

(71) Applicants: Mark Larson, Provo, UT (US); Michael Lines, Cedar Hills, UT (US); Erik Bard, Lehi, UT (US)

(72) Inventors: Mark Larson, Provo, UT (US); Michael Lines, Cedar Hills, UT (US); Erik Bard, Lehi, UT (US)

( * ) Notice: Subject to any disclaimer, the term of this patent is extended or adjusted under 35 U.S.C. 154(b) by 0 days.

(21) Appl. No.: 14/384,383

(22) PCT Filed: Mar. 11, 2013

(86) PCT No.: PCT/US2013/030306

§ 371 (c)(1),
(2) Date: Sep. 10, 2014

(87) PCT Pub. No.: WO2013/138258

PCT Pub. Date: Sep. 19, 2013

(65) Prior Publication Data

US 2015/0016593 A1 Jan. 15, 2015

Related U.S. Application Data

(60) Provisional application No. 61/609,314, filed on Mar. 11, 2012.

(51) Int. Cl.

| | |
|---|---|
| ***G21K 1/00*** | (2006.01) |
| ***H01J 5/18*** | (2006.01) |
| *H01J 35/18* | (2006.01) |

(52) U.S. Cl.
CPC ... *G21K 1/00* (2013.01); *H01J 5/18* (2013.01); *H01J 35/18* (2013.01)

(58) Field of Classification Search
CPC ..... G21K 1/00; H01J 35/18; H01J 5/18
USPC ..... 250/505.1
See application file for complete search history.

(56) References Cited

U.S. PATENT DOCUMENTS

| | | | |
|---|---|---|---|
| 3,828,190 | A | 8/1974 | Dahlin et al. |
| 4,862,490 | A | 8/1989 | Karnezos et al. |
| 4,933,557 | A | 6/1990 | Perkins et al. |
| 4,939,763 | A | 7/1990 | Pinneo et al. |
| 4,960,486 | A | 10/1990 | Perkins et al. |
| 5,039,203 | A | 8/1991 | Nishikawa |
| 5,173,612 | A | 12/1992 | Imai et al. |
| 5,258,091 | A | 11/1993 | Imai et al. |
| 5,432,003 | A | 7/1995 | Plano et al. |
| 5,578,360 | A | 11/1996 | Viitanen |
| 5,612,588 | A | 3/1997 | Wakalopulos |
| 6,002,202 | A | 12/1999 | Meyer et al. |

(Continued)

*Primary Examiner* — Kiho Kim

(57) ABSTRACT

An improved radiation window comprises a film permeable to radiation disposed on a support structure. The support structure comprises a primary transmissive area comprising a plurality of support members defining a plurality of apertures for radiation to pass through; a flange disposed around the periphery of the primary transmissive area having generally greater mechanical rigidity than the primary transmissive area; and a transition region disposed between, and contiguous with, the primary transmissive area and the flange; the transition region having generally greater mechanical rigidity than the primary transmissive area and generally lesser mechanical rigidity than the flange, thereby providing an intermediate rigidity transition between the dissimilar rigidities of the primary transmissive area and the flange. A radiation detection system comprises a sensor configured to detect radiation, disposed behind such an improved radiation window.

20 Claims, 7 Drawing Sheets

(56) References Cited

U.S. PATENT DOCUMENTS

| | | | | |
|---|---|---|---|---|
| 7,035,379 | B2 | 4/2006 | Turner et al. | |
| 7,233,647 | B2 | 6/2007 | Turner et al. | |
| 7,618,906 | B2 | 11/2009 | Meilahti | |
| 7,660,393 | B2 | 2/2010 | Sipilä et al. | |
| 7,709,820 | B2 | 5/2010 | Decker et al. | |
| 7,737,424 | B2 | 6/2010 | Xu et al. | |
| 7,756,251 | B2 | 7/2010 | Davis et al. | |
| 8,929,515 | B2 | 1/2015 | Liddiard | |
| 8,989,354 | B2 | 3/2015 | Davis et al. | |
| 9,076,628 | B2 | 7/2015 | Davis | |
| 2008/0296479 | A1 | 12/2008 | Anderson et al. | |
| 2009/0173897 | A1* | 7/2009 | Decker et al. | 250/505.1 |
| 2011/0121179 | A1 | 5/2011 | Liddiard et al. | |
| 2012/0025110 | A1 | 2/2012 | Davis et al. | |
| 2013/0000253 | A1 | 1/2013 | Åberg et al. | |
| 2014/0044240 | A1 | 2/2014 | Pahlke et al. | |

* cited by examiner

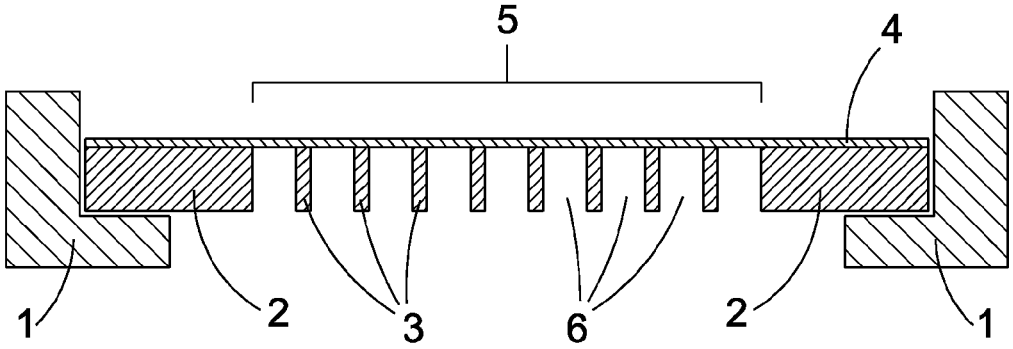
Prior Art Fig. 1
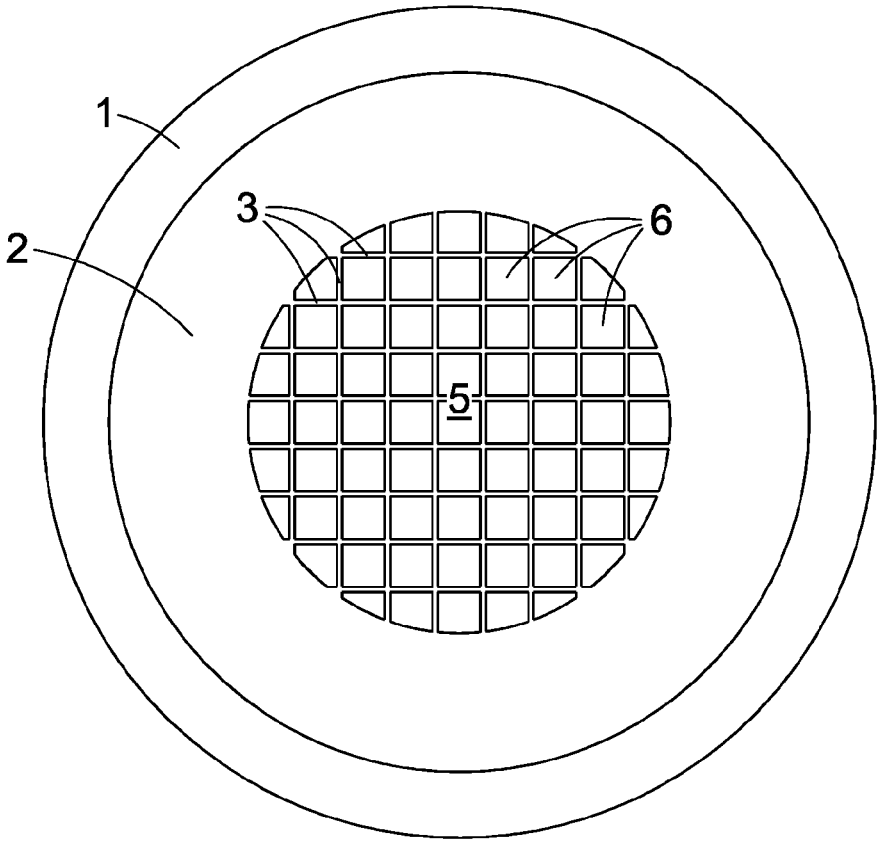
Prior Art Fig. 2

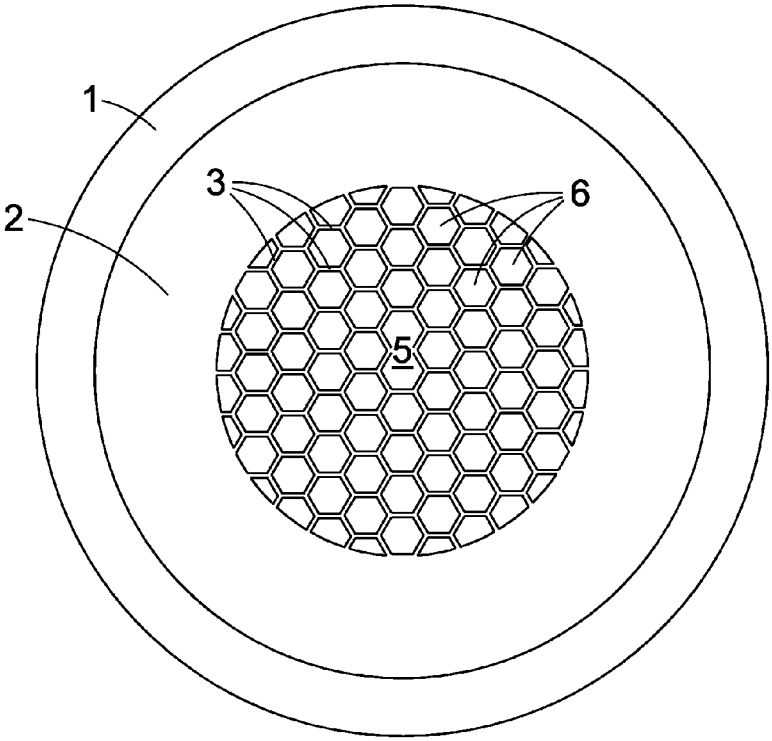
Prior Art Fig. 3
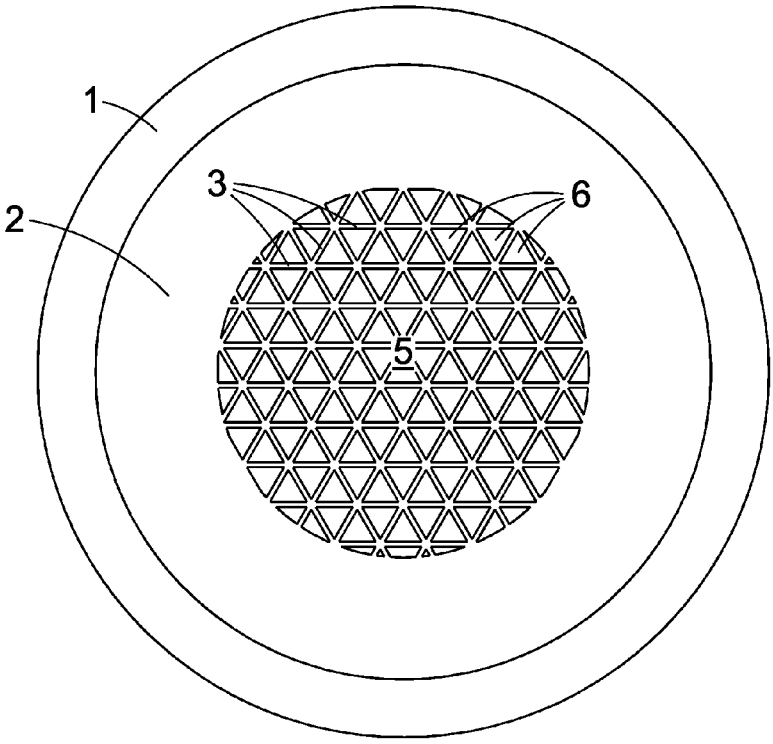
Prior Art Fig. 4

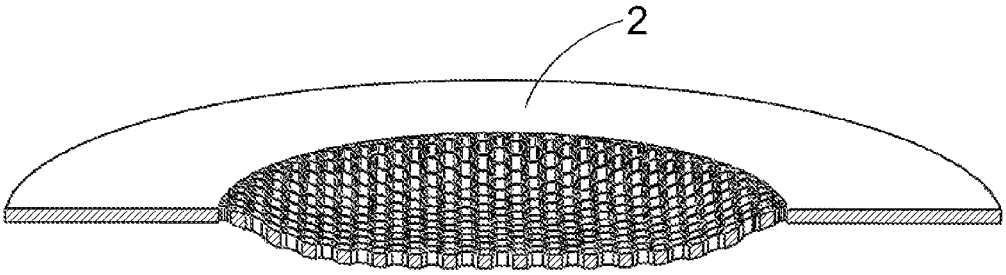
Prior Art Fig. 5
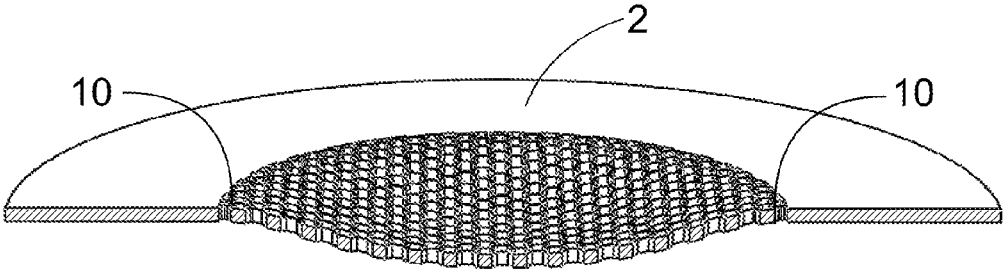
Fig. 6
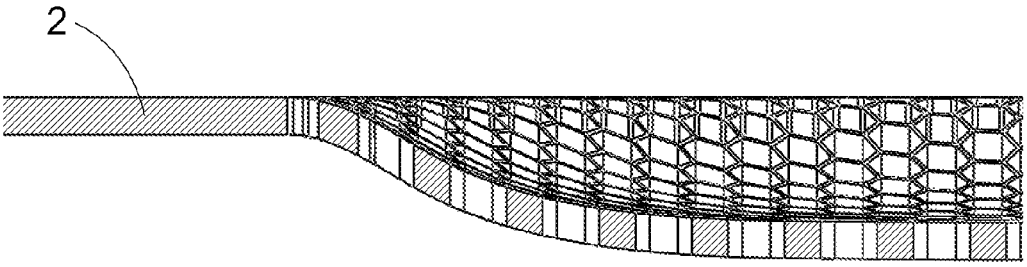
Prior Art Fig. 7
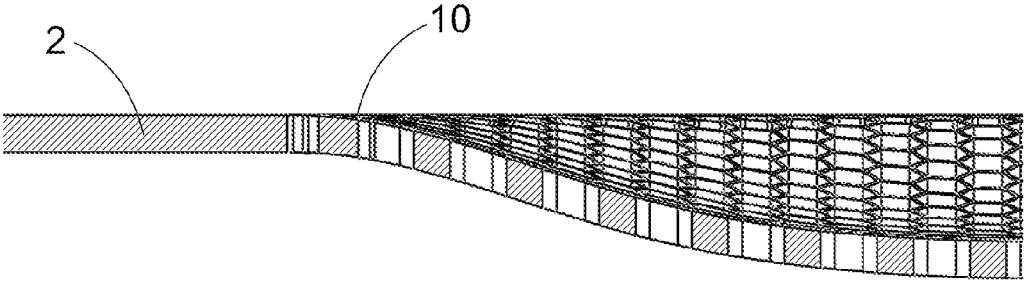
Fig. 8

RADIATION WINDOW WITH SUPPORT STRUCTURE

TECHNICAL FIELD

The present invention relates to radiation-transmitting windows, and to devices employing radiation-transmitting windows.

BACKGROUND ART

A radiation window is a physical structure that transmits incident radiation (e.g., gamma rays, x-rays, ultraviolet light, infrared radiation, alpha particles, beta particles, electrons, protons, neutrons, etc.) while blocking unwanted species (e.g., gases, liquids, mobile solids, visible light, other radiation, etc.). When the primary purpose of a such a structure is to selectively transmit certain radiation while blocking other radiation, the structure is often referred to as a "filter." As used herein, the term "window" refers to all such radiation-transmitting structures, regardless of what species they are intended to block.

Radiation windows are typically employed in devices that produce, detect, and/or analyze radiation. By way of example, x-ray florescence (XRF) devices, energy dispersive spectroscopy (EDS) devices, and x-ray diffraction (XRD) devices, all of which provide information about the elemental and/or structural composition of a material specimen by analyzing x-rays emitted from the specimen after it has been subjected to irradiation, typically employ an x-ray detector encased in a protective housing with a radiation window that allows the x-rays to penetrate the housing and reach the detector. In such applications, the radiation window is commonly referred to as an "x-ray window." Common examples of x-ray detectors used in such applications are silicon drift detectors (SDD), quantum dot detectors (QDD), silicon-lithium (SiLi) detectors, and PIN diodes. Such detectors must typically be cooled substantially below room temperature to reduce electronic noise and improve performance. To protect the detector from degradation caused by environmental contaminants, the detector is typically sealed inside the protective housing under high vacuum or, alternatively, filled with a small amount of gas under partial vacuum. The vacuum or partial vacuum inside the detector housing is also important to minimize the attenuation of low-energy x-rays (often referred to as "soft x-rays"), which are easily absorbed by gas molecules.

There are many other applications for radiation windows, but two competing requirements common to most of them are that the windows must be thin enough to transmit the desired radiation with as little absorption or attenuation as reasonably possible while at the same time being robust enough to withstand whatever forces may be exerted on the windows (by differential pressures, mechanical vibrations, accelerations, etc.) without breaking or otherwise losing integrity, such as developing cracks or fissures that allow unwanted gases, radiation, or other species to leak through the window. These two competing requirements become increasingly problematic when the desired radiation is easily absorbed by any kind of solid matter, such as the case of soft x-rays emitted from irradiated "light elements" (i.e. elements of low atomic number, such as Li, B, C, N, O, and F), which have difficulty penetrating even extremely thin—and therefore very fragile—windows.

Thin radiation windows are usually made of materials composed primarily of relatively light elements, since such elements are typically less absorptive, and thus more transmissive, of weakly-penetrating radiation. Thin window materials used in the prior art include beryllium, aluminum, diamond, mica, quartz (silicon dioxide), boron, boron hydride, boron hydride alloy, boron nitride, silicon nitride, and polymers such as polyimide, polypropylene, polyethylene, polyester, polycarbonate, poly-vinyl formal (commonly referred to by the former trademark Formvar), poly-paraphenylene terephthalamide (commonly referred to by the registered trademark Kevlar®), etc. The window materials are fashioned into thin foils or films (all of which are referred to herein as "films") which are attached across an opening in a more mechanically robust structure or housing (hereinafter referred to as a "window housing"). Polymers are often the film material of choice for extremely thin radiation windows (on the order of a few microns or less), primarily because they are less dense —and therefore more transmissive —than most other window materials, and because thin polymer films are typically less brittle than similarly transmissive films of other window materials. However, because thin polymer films are very permeable to gas molecules, they must be coated with a gas barrier layer (for example, a few hundred angstroms of aluminum) for applications which require a gas-tight window, such as the x-ray detectors mentioned above. Polymer films may also require thin coatings of non-polymeric materials for other purposes, including radiation filtration (such as a metallic layer on an x-ray window to filter out unwanted ultraviolet, visible, and/or infrared radiation) and electrical properties (such as a thin metallic coating to provide electrical conductivity on windows used in "proportional counter" radiation detectors).

In many applications, especially those in which the window must withstand substantial forces acting on it—such as where there is atmospheric pressure on one side of the window and vacuum on the other side—it may not be feasible for a free-standing film of the window material to span the opening in the window housing. In such situations, it is customary to employ a support structure, such as a rigid mesh or grid, to provide mechanical support for the window film. The primary design goals for such a support structure are to provide the requisite mechanical strength and rigidity to support the window film while interfering as little as possible with the transmission of the desired radiation.

As illustrated by way of examples in Prior Art FIGS. 1-4, support structures come in many different geometries and configurations, but common to all of them is a transmissive area 5 comprising a pattern or array of solid members 3 (hereinafter "support members") to support the window film 4, and corresponding apertures 6 to allow the radiation to pass through the support structure. Configurations of support members and corresponding apertures used in the prior art include arrays of straight ribs and slots, round holes, polygonal holes (hexagons, rectangles, squares, triangles, etc.), and combinations of these. As suggested by the multiple reference lines for the support members 3 in the above-referenced Figures, the term "support member" as used herein refers to each individual segment making up the pattern or array of solid members supporting the window film, and not to the pattern or array as a whole.

Support structures also typically have a flange 2 peripheral to the transmissive area 5 for the purpose of attaching the support structure to the window housing 1. It should be noted that the flange may also be transmissive of radiation, but as a general rule the flange will transmit to a lesser degree than the transmissive area.

In the prior art, support structures have been made of relatively rigid materials such as silicon, quartz (silicon dioxide), diamond, boron, boron hydride, boron nitride, silicon nitride, and various metals including nickel, tungsten, molybdenum, stainless steel, aluminum, beryllium, and copper.

The inherent drawback of support structures is that they inevitably obscure a portion of the incident radiation, thus decreasing the overall transmission or performance of the window. Another potential drawback is that the material of the support structure itself, when exposed to the incident radiation, may be induced to emit radiation of its own which could contaminate the spectrum of the radiation passing through the window. These can be substantial drawbacks in applications where the quantity and/or spectral purity of the transmitted radiation are of concern.

One obvious way to increase the transmission of radiation through a given support structure is to modify the design of the support members and/or apertures so as to increase the fractional open area (i.e., the aggregate area of the apertures divided by the total area). However, this strategy can only be carried so far, since it eventually leads to a support structure which no longer has enough strength and/or rigidity to perform its critical function of supporting the window film.

Another way to increase the transmission of radiation through a support structure is to decrease the thickness of the support structure itself, thus decreasing the amount of radiation absorbed by the support members. This strategy can be particularly beneficial in applications where the window is intended to transmit radiation of varying energies or wavelengths, such as in typical XRF, EDS, or XRD systems, because although the less-penetrating radiation may still be completely absorbed (and therefore obscured) by the support members, a higher percentage of the more-penetrating radiation can potentially be transmitted through the support members (and therefore only partially obscured by them). Once again, however, this strategy can only be carried so far, since it also eventually leads to a support structure which no longer has enough strength and/or rigidity to perform its critical function of supporting the window film.

A third way to increase the transmission of radiation through the support structure is to select a material for the support structure which is less absorptive of the incident radiation. This strategy can also address the problem of spectral contamination, since a material which is less absorptive of the incident radiation is also less likely to become excited by it and induced to emit radiation of its own. However, this strategy is quite problematic, since materials which are less absorptive are also typically less mechanically robust and rigid. For example, support structures made of polymers have been proposed (see U.S. Pat. No. 5,578,360), since polymers are less brittle and more transmissive than other materials currently in use, but their lack of rigidity has prevented them from being seriously adopted. Simply put, if the support structure flexes too much, it results in failure of the window film.

SUMMARY OF THE DISCLOSURE

The improved radiation window of the present invention incorporates a mechanical support structure which can be made with greater fractional open area and/or thinner support members and/or more transmissive materials than existing radiation window support structures. As a result, the support structure of this improved radiation window can be made from any or all of the materials which are, or could be, used in existing support structures, as well as other materials which are not well-suited for existing support structures. By way of example and not limitation, in accordance with at least one embodiment, the support structure is made of polymer.

BRIEF DESCRIPTION OF THE DRAWINGS

Prior Art FIG. 1 is a cross-sectional view of a prior-art radiation window with support structure, attached to a window housing;

Prior Art FIGS. 2 to 4 are alternative top views of the prior-art window and housing of Prior Art FIG. 1, with the window film removed to show examples of the various prior-art geometries for the support structure;

Prior Art FIG. 5 is a perspective sectional view of a prior-art radiation window support structure with a hexagonal mesh, illustrating the deflection of the mesh when subjected to a differential force or pressure;

FIG. 6 is a perspective sectional view of an improved radiation window support structure according to one embodiment, illustrating the more gradual deflection of the mesh when subjected to a differential force or pressure;

Prior Art FIG. 7 is an enlarged cross-sectional view of the left half of the prior-art radiation window support structure of Prior Art FIG. 5;

FIG. 8 is an enlarged cross-sectional view of the left half of the improved radiation window support structure of FIG. 6;

DETAILED DISCLOSURE

Figure 9:
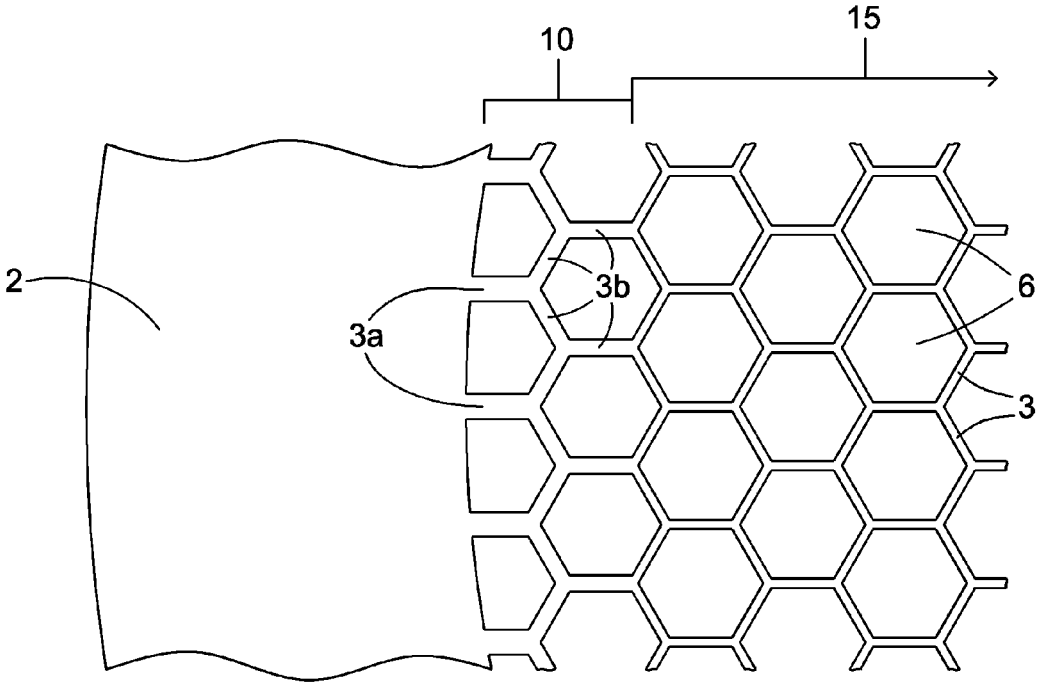
FIGS. 9 to 14 are top views of a portion of an improved radiation window support structure according to various embodiments.

Referring to Prior Art FIGS. 5 and 7, the inventors have determined via experimentation and empirical analysis that the initial point of failure for a radiation window with a support structure that is deficient in strength and/or rigidity is typically in the vicinity where the flange 2 and the transmissive area 5 (not labeled in these Figures) of the support structure meet. The typical mode of failure is that the window film 4 (not shown in these Figures) in this vicinity develops cracks or fissures, which can happen even if the underlying support structure remains intact. In the case of polymer window films coated with a less flexible material (e.g. aluminum, beryllium, boron, boron hydride, boron nitride, quartz, etc.), it is typically the coating which develops cracks or fissures first, rather than the polymer film itself. In more extreme cases, the support structure itself may crack, break, or become permanently deformed in this vicinity, resulting in even greater damage to the window film 4. In many applications, such as those which require the window to form a gas-tight seal, even very small cracks or fissures in the window film 4 or its coating can be detrimental to the proper functioning of the window.

Referring to FIGS. 6 and 8, the inventors have demonstrated that such failures can be prevented by the introduction of an advantageously engineered transition region 10 between the flange 2 and the transmissive area 5 (not labeled in these Figures) of the support structure. Specifically, the rigidity of the support structure in the transition region 10 is designed to be more rigid than the transmissive area 5 of the support structure, but less rigid than the flange 2 of the support structure, thereby providing a more gradual transition between the dissimilar rigidities of the transmissive area 5 and the flange 2. As illustrated by comparing FIGS. 6 and 8 with Prior Art FIGS. 5 and 7, the introduction of this transition region 10 results in less severe bending or deformation of the support structure between the flange 2 and the transmissive area 5 than in prior-art support structures, which have a much more abrupt change in local structural rigidity due to the abrupt interface between the flange 2 and the transmissive area 5. The introduction of this transition region 10 thus results in a decrease in stress concentrations on the window film 4 in this region, thereby reducing the likelihood of window failure.

Because rigidity is a composite property of material and geometry, the intermediate rigidity of the transition region 10 can be engineered by modifying either the material properties in that region, or the geometry in that region, or both. Such modifications can be applied as one or more discrete changes throughout the transition region 10, or as a continuous change, or a combination of both.

One advantage of this improved radiation window support structure is that, unlike the prior-art solution of increasing the rigidity—and consequently the opacity—of the entire transmissive area 5 in order to prevent window failure, this modification to rigidity need only be made to the transition region 10 of the support structure, so it can be designed to have relatively little, if any, detrimental effect on the overall transmission of the support structure. In particular, the transition region 10 can often be designed to be completely outside of the radiation beam path. This advantage and other advantages of one or more embodiments or aspects will become apparent from a consideration of the ensuing description and accompanying drawings. Although the drawings illustrate various embodiments using generally circular support structures with hexagonal apertures, this is not meant as a limitation on the embodiments, as any useful geometries can be used and are intended to be included in the embodiments, including without limitation all geometries shown in the prior art.

The geometry of the transition region 10 can advantageously be based upon, patterned after, or derived from the geometry in the transmissive area 5, but such need not be the case. For ease of visualization, the majority of the following discussion follows this approach, describing how a prior-art radiation window support structure can be structurally transformed into an improved radiation window of the present invention by modifying the support members 3 and apertures 6 on the periphery of the transmissive area 5 to create the requisite transition region 10. However, it must be emphasized that this in no way implies that the transition region 10 must be formed by modifying the periphery of the transmissive area 5 of a prior art radiation window. On the contrary, the structural features making up the transition region 10 can just as effectively be formed by modifying the inner portion of the flange 2 adjacent to the transmissive area 5 of a prior-art window, or by the introduction of new materials or geometry to create the transition region 10. Either way, the net result is a window with a transition region 10 disposed between the flange 2 and the transmissive area 5, in accordance with the present disclosure.

Because the transition region 10 can be advantageously designed to transmit radiation, as does the transmissive area 5, and can therefore be advantageously used either in addition to, or in replacement of, the peripheral portion of the transmissive area 5, the following discussion will use the term "primary transmissive area" (identified in the following Figures as 15) to refer to the non-transitional transmissive area of an improved radiation window support structure according to the present disclosure.

Figure 10:
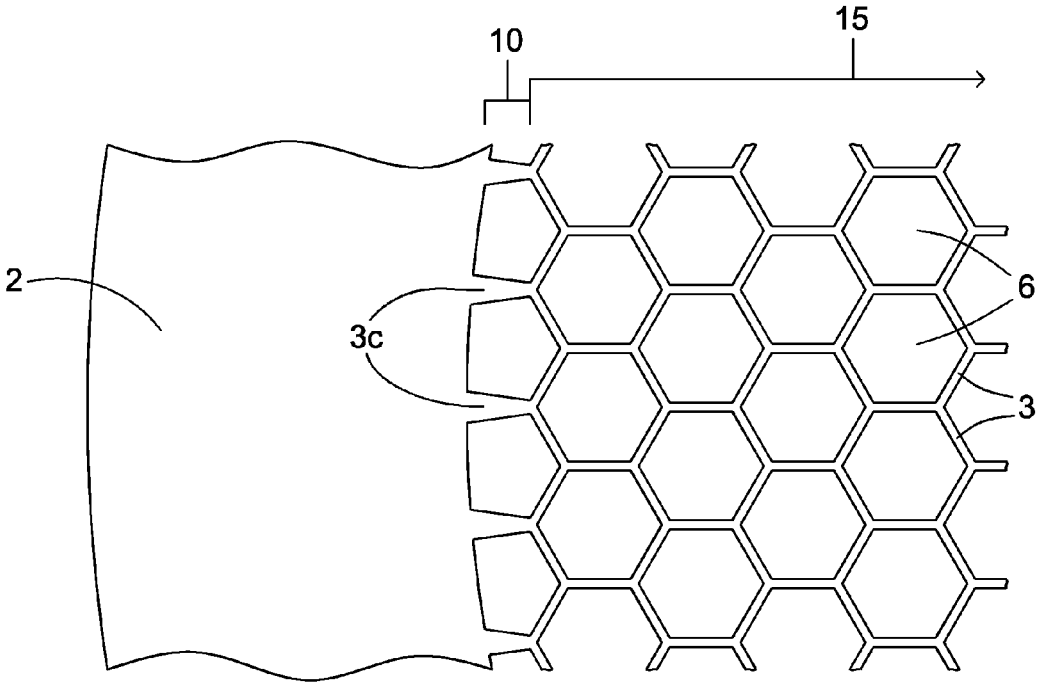

Referring to FIG. 9, in one embodiment of the improved radiation window support structure, the transition region 10 is made to be generally more rigid than the primary transmissive area 15 by providing support members 3*a* and 3*b* with lateral widths greater than the lateral widths of adjacent support members in the primary transmissive area 15. Although this Figure shows this feature being implemented in two discrete steps—support members 3*b* being wider, and therefore more rigid, than the support members 3 in the primary transmissive area 15, and support members 3*a* being wider than support members 3*b*—one skilled in the art will appreciate that such transition in rigidity could be advantageously implemented in fewer steps or more steps. It could also be implemented in a continuum, as illustrated in FIG. 10, which shows support members 3*c* in transition region 10 having widths that vary continuously along their length. Of course, such a continuous variation does not have to be linear. A further variation of this embodiment is to provide smaller apertures in the transition region 10 than those in the primary transmissive area 15, resulting in wider support members in the transition region 10 than in the primary transmissive area 15.

Figure 11:
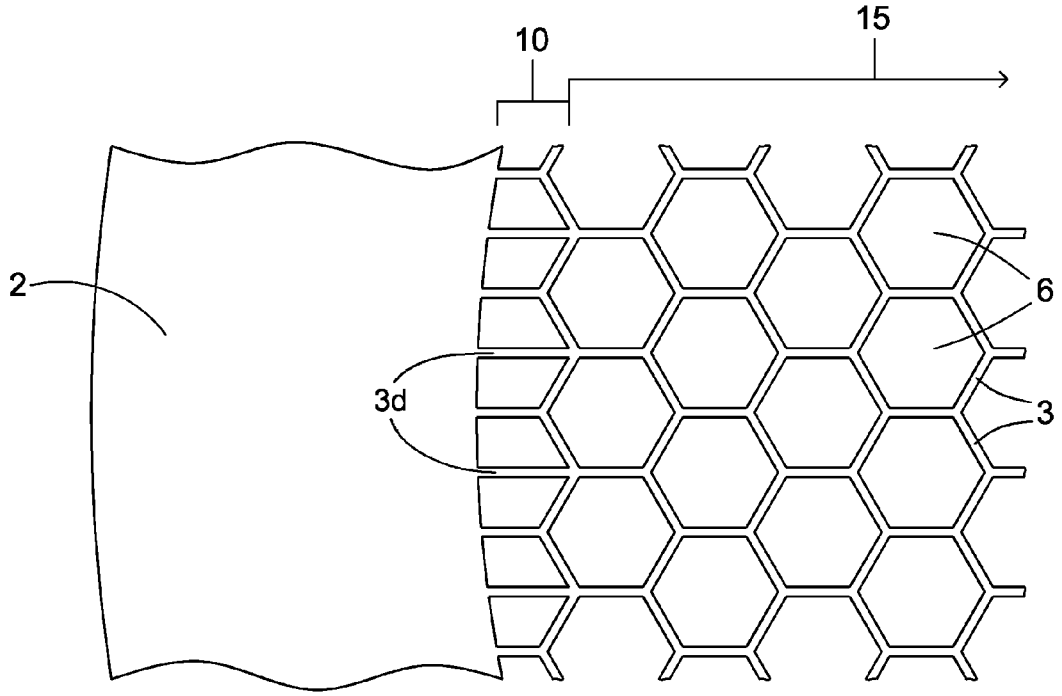

In another embodiment, transition region 10 is made to be generally more rigid than the primary transmissive area 15 by the inclusion of support members having a greater spatial frequency than the general spatial frequency of the neighboring support members 3 in the primary transmissive area 15. This is illustrated in FIG. 11, which shows the inclusion of support members 3*d* in the transition region 10, thereby providing a higher spatial frequency of support members, and therefore a greater general rigidity, in the transition region 10 than in the primary transmissive area 15. One skilled in the art will appreciate that any number of support members of various sizes, shapes, and geometries can be incorporated in this way and are included in this embodiment.

Figure 12:
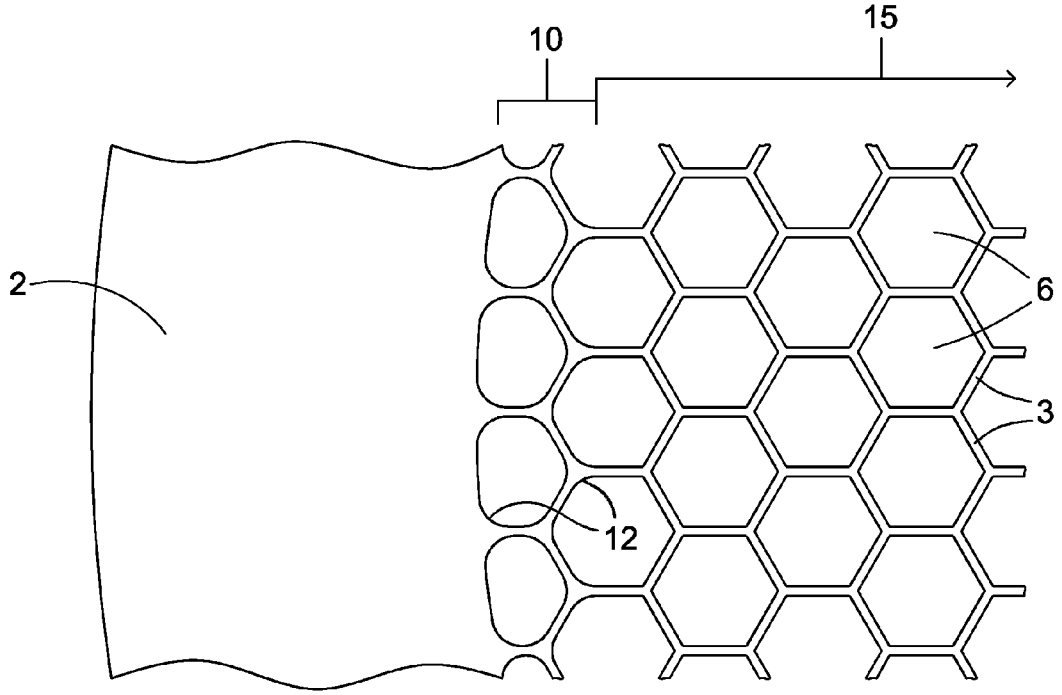

Referring to FIG. 12, in a further embodiment, transition region 10 is made to be generally more rigid than the primary transmissive area 15 by partially filling some or all of the vertices 12 formed at the locations where the support members 3 in the transition region 10 intersect with each other or with the flange 2. The material used to fill the vertices would normally be the same as that of the support members, but such need not be the case. Further, the filling of the vertices can take any form, including without limitation fillets, chamfers, etc., and all such variations are included in this embodiment. Moreover, the vertices need not be filled to the same degree nor with the same filling geometry.

Figure 13:
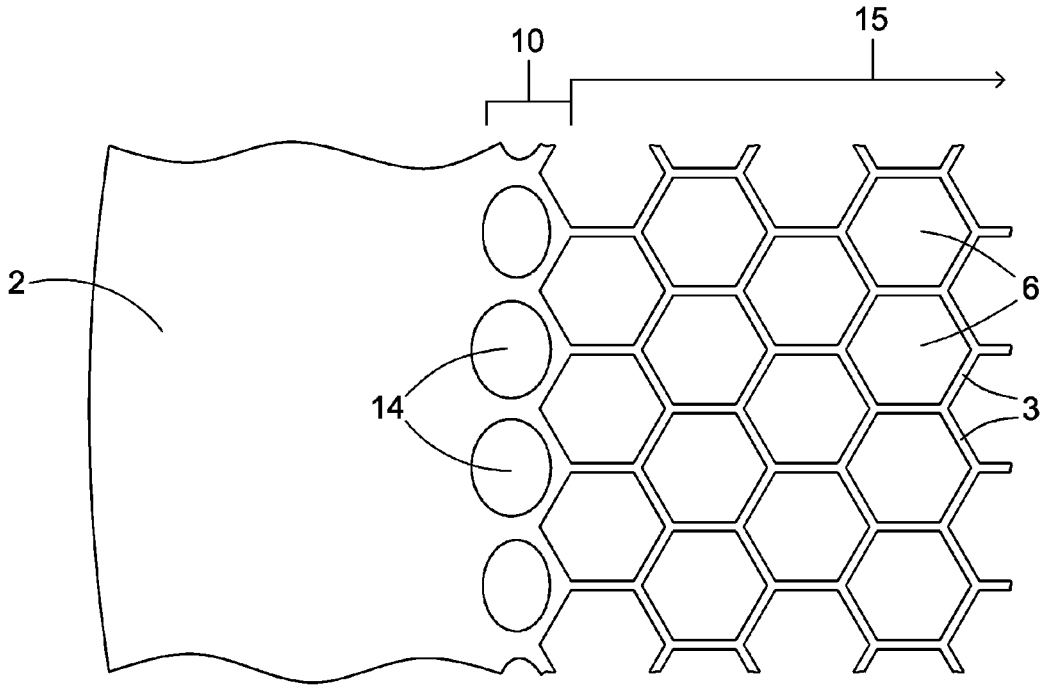

In another embodiment, transition region 10 is made to be generally more rigid than the primary transmissive area 15 by the inclusion of apertures in the transition region 10 that are different in size and/or shape from the neighboring apertures in the primary transmissive area 15. This is illustrated in FIG. 13, which shows hexagonal apertures 6 in the primary transmissive area 15 and smaller oval apertures 14 in the transition region 10. One skilled in the art will appreciate that the apertures in transition region 10 could be any of an endless variety of shapes and sizes, and all such modifications are included in this embodiment.

Figure 15:
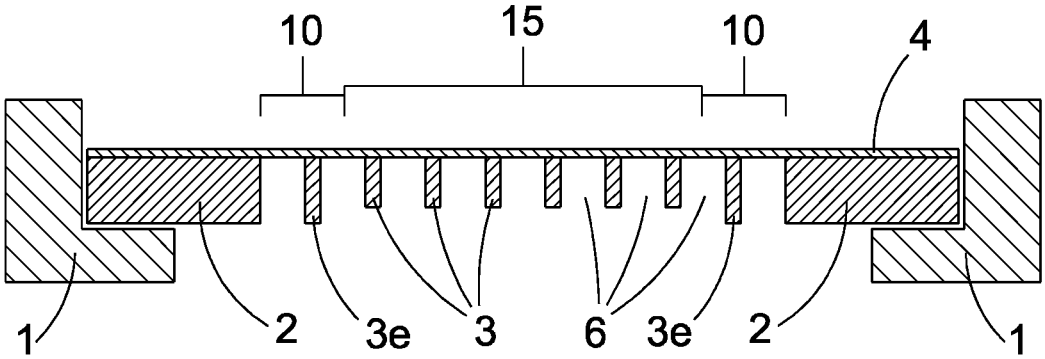
FIGS. 15 and 16 are cross-sectional views of an improved radiation window with support structure according to certain embodiments, attached to a window housing.

In another embodiment, illustrated in FIG. 15, transition region 10 is made to be generally more rigid than the primary transmissive area 15 by the inclusion of support members 3*e* in transition region 10 that have vertical thicknesses greater than the vertical thicknesses of adjacent support members 3 in the primary transmissive area 15. Such differences in vertical thickness of support members can be formed by selective etching of a support structure having an original thickness profile different from the desired thickness profile, including a support structure of originally uniform vertical thickness. Such etching can be accomplished by means of reactive ion etching, plasma etching, laser ablation, ion milling, etc. Such differences in vertical thickness of support members can also be accomplished using a layered approach with a photodefinable material.

In yet another embodiment, transition region 10 is made to be generally more rigid than the primary transmissive area 15, but still generally less rigid than the flange 2, by selectively modifying the bulk modulus of the material of the transition region 10. This can be accomplished by such means as localized radiation treatment, ion implantation, heat-treatment (e.g. with a laser), etc.

Figure 16:
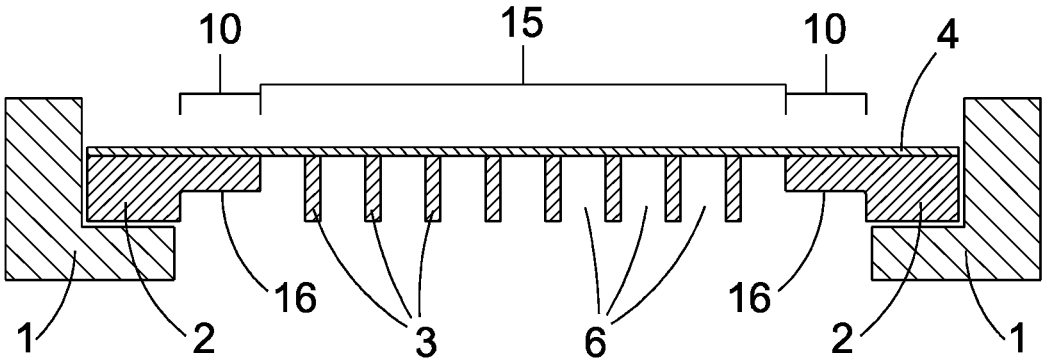

In a further embodiment, illustrated in FIG. 16, transition region 10 has a vertical thickness or thicknesses less than the adjacent vertical thickness of the flange 2, resulting in transition region 10 being generally less rigid than the flange 2, but still generally more rigid that the primary transmissive area 15. Although FIG. 16 shows this feature 16 having a uniform vertical thickness, it can also be implemented—as can all of the embodiments shown herein—in one or more discrete steps throughout the transition region 10, or as a continuous change, or a combination of both.

Figure 14:
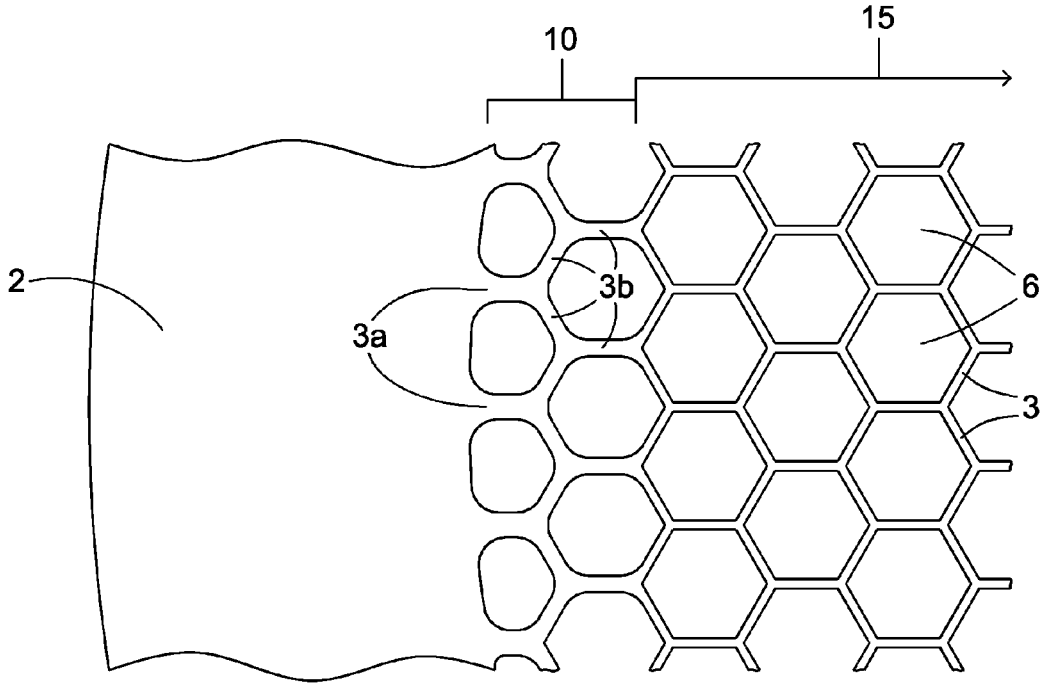

The embodiments enumerated above are not intended to be an exclusive or exhaustive list of the embodiments covered by this invention. In addition to the above expressly enumerated embodiments, there are other and further embodiments which will be apparent to a person skilled in the art. Further, any and/or all of the above embodiments can be combined together, and all such combinations are considered covered by this invention. One such combination is illustrated by way of example in FIG. 14, which shows a combination of the embodiments illustrated in FIGS. 9 and 12.

By way of example and not limitation, the support structure of the improved radiation window can advantageously be made from such materials as diamond, carbon, carbon composite, boron, boron hydride, boron nitride, silicon, silicon nitride, quartz, aluminum oxide, and various metals including beryllium, beryllium-copper, aluminum, magnesium, nickel, tungsten, molybdenum, stainless steel, copper, etc. Said support structure can also advantageously be made from polymers, including without limitation polyimide, polypropylene, polyethylene, polyester, polycarbonate, poly-vinyl formal, poly-paraphenylene terephthalamide, etc. Said support structure can be manufactured using photodefinable materials, including photodefinable polymers, or by other methods known in the art, such as reactive ion etching, plasma etching, laser ablation, ion milling, etc.

Further, the film and support structure of the improved radiation window can comprise the same material, and can be manufactured as separate entities or as an integral unit. By way of example only, a polymer window film could be manufactured with an integral polymer support structure, or a diamond window film with an integral diamond support structure.

The present invention also covers radiation detectors and radiation sources which employ an improved radiation window as disclosed herein, including, but not limited to, x-ray detectors and x-ray sources which employ such a window. Such a radiation detection system comprises a sensor configured to detect radiation, disposed behind such an improved radiation window.

While the foregoing written description enables one of ordinary skill to make and use the invention, those of ordinary skill will understand and appreciate the existence of variations, combinations, and equivalents of the specific embodiments, methods, and examples herein. The invention should therefore not be limited by the above described embodiments, methods, and examples, but by all embodiments and methods that are within the scope and spirit of the invention.

We claim:

1. A radiation window comprising a film permeable to radiation disposed on a support structure, said support structure comprising:

(a) a primary transmissive area comprising a plurality of support members defining a plurality of apertures for radiation to pass through;

(b) a flange disposed around the periphery of said primary transmissive area, said flange having generally greater mechanical rigidity than said primary transmissive area;

(c) a transition region disposed between, and contiguous with, said primary transmissive area and said flange; and (d) said transition region having generally greater mechanical rigidity than said primary transmissive area and generally lesser mechanical rigidity than said flange, thereby providing an intermediate rigidity transition between the dissimilar rigidities of said primary transmissive area and said flange.

2. The radiation window of claim 1 wherein the material of said film includes a material selected from the group consisting of beryllium, aluminum, magnesium, diamond, mica, quartz, boron, boron hydride, boron hydride alloy, boron nitride, silicon nitride, and polymer.

3. The radiation window of claim 1 wherein the material of said film includes a polymer selected from the group consisting of polyimide, polypropylene, polyethylene, polyester, polycarbonate, poly-vinyl formal, and poly-paraphenylene terephthalamide.

4. The radiation window of claim 1 wherein the material of said support structure includes a material selected from the group consisting of beryllium, beryllium-copper, diamond, carbon, carbon composite, boron, boron hydride, boron nitride, silicon, silicon nitride, quartz, aluminum, aluminum oxide, magnesium, nickel, tungsten, molybdenum, stainless steel, copper, and polymer.

5. The radiation window of claim 1 wherein the material of said support structure includes a polymer selected from the group consisting of polyimide, polypropylene, polyethylene, polyester, polycarbonate, poly-vinyl formal, and polyparaphenylene terephthalamide.

6. The radiation window of claim 1 wherein the material of said support structure comprises a photodefinable material.

7. The radiation window of claim 1 wherein said support structure is formed by reactive ion etching.

8. The radiation window of claim 1 wherein said support structure is formed by laser cutting or laser ablation.

9. The radiation window of claim 1, further comprising a gas barrier layer disposed over said film.

10. The radiation window of claim 9 wherein the material of said gas barrier layer includes a material selected from the group consisting of beryllium, aluminum, aluminum oxide, diamond, boron, boron hydride, boron nitride, silicon nitride, quartz, magnesium, and graphene.

11. The radiation window of claim 1 wherein the material of said film and the material of said support structure include a same material.

12. The radiation window of claim 1 wherein said transition region of said support structure comprises a plurality of support members having lateral widths greater than the lateral widths of adjacent support members in said primary transmissive area.

13. The radiation window of claim 1 wherein said transition region of said support structure comprises a plurality of support members having a greater spatial frequency than the general spatial frequency of the neighboring support members in said primary transmissive area.

14. The radiation window of claim 1 wherein said transition region of said support structure comprises a plurality of support members intersecting said flange or other support members, wherein at least a subset of the vertices formed at the locations of intersection are partially filled with a same material as said support members.

15. The radiation window of claim 1 wherein said transition region of said support structure comprises a plurality of support members having vertical thicknesses greater than the vertical thicknesses of adjacent support members in said primary transmissive area.

16. The radiation window of claim 1 wherein said transition region of said support structure has vertical thickness or thicknesses less than the adjacent vertical thickness of said flange.

17. The radiation window of claim 1 wherein the rigidity of the material of said transition region has been modified by modulus altering means.

18. A radiation detection system comprising a sensor configured to detect radiation, disposed behind a radiation window, said radiation window comprising:

(a) a film permeable to radiation disposed on a support structure, said support structure comprising:

(i) a primary transmissive area comprising a plurality of support members defining a plurality of apertures for radiation to pass through;

(ii) a flange disposed around the periphery of said primary transmissive area, said flange having generally greater mechanical rigidity than said primary transmissive area;

(iii) a transition region disposed between said primary transmissive area and said flange; and (iv) said transition region having generally greater mechanical rigidity than said primary transmissive area and generally lesser mechanical rigidity than said flange, thereby providing a intermediate rigidity transition between the dissimilar rigidities of said primary transmissive area and said flange.

19. The radiation detection system of claim 18 wherein the material of said film includes a material selected from the group consisting of beryllium, aluminum, magnesium, diamond, mica, quartz, boron, boron hydride, boron hydride alloy, boron nitride, silicon nitride, and polymer.

20. The radiation detection system of claim 18 wherein the material of said support structure includes a material selected from the group consisting of beryllium, beryllium-copper, diamond, carbon, carbon composite, boron, boron hydride, boron nitride, silicon, silicon nitride, quartz, aluminum, aluminum oxide, magnesium, nickel, tungsten, molybdenum, stainless steel, copper, and polymer.

* * * * *